US007614110B2

(12) United States Patent
Akai et al.

(10) Patent No.: US 7,614,110 B2
(45) Date of Patent: Nov. 10, 2009

(54) WET SHEET FOR CLEANING

(75) Inventors: Hiroyuki Akai, Tochigi (JP); Kouji Machii, Tochigi (JP); Akihito Shizuno, Tochigi (JP)

(73) Assignee: Kao Corporation, Tokyo (JP)

( * ) Notice: Subject to any disclaimer, the term of this patent is extended or adjusted under 35 U.S.C. 154(b) by 812 days.

(21) Appl. No.: 10/521,961

(22) PCT Filed: Jul. 23, 2003

(86) PCT No.: PCT/JP03/09349

§ 371 (c)(1),
(2), (4) Date: Sep. 28, 2005

(87) PCT Pub. No.: WO2004/008934

PCT Pub. Date: Jan. 29, 2004

(65) Prior Publication Data

US 2006/0096051 A1 May 11, 2006

(30) Foreign Application Priority Data

Jul. 24, 2002 (JP) ..... 2002-215337
Sep. 18, 2002 (JP) ..... 2002-270845

(51) Int. Cl.
*A47L 13/17* (2006.01)
*A47L 13/20* (2006.01)

(52) U.S. Cl. ..... 15/104.93; 15/209.1; 15/231; 442/327

(58) Field of Classification Search ..... 15/104.93, 15/209.1, 210.1, 231; 442/327
See application file for complete search history.

(56) References Cited

U.S. PATENT DOCUMENTS

| | | | | |
|---|---|---|---|---|
| 4,603,069 | A | 7/1986 | Haq et al. | |
| 6,376,046 | B1 | 4/2002 | Hoshino et al. | |
| 6,750,165 | B2 * | 6/2004 | Kakiuchi et al. | 442/319 |

FOREIGN PATENT DOCUMENTS

| | | | |
|---|---|---|---|
| JP | 57-75860 | U | 5/1982 |
| JP | 59-108533 | A | 6/1984 |
| JP | 4-33971 | A | 3/1992 |
| JP | 8-311835 | A | 11/1996 |
| JP | 9-131288 | A | 5/1997 |
| JP | 10-127549 | A | 5/1998 |
| JP | 10-262889 | A | 10/1998 |
| JP | 10-272082 | A | 10/1998 |
| JP | 2001-198065 | A | 7/2001 |
| JP | 2002-45323 | A | 2/2002 |

* cited by examiner

*Primary Examiner*—Randall Chin
(74) *Attorney, Agent, or Firm*—Birch, Stewart, Kolasch & Birch, LLP

(57) ABSTRACT

A wet cleaning sheet 1 has a liquid retentive sheet 12 made of a fibrous material or a cellular material and impregnated with a predetermined amount of a detergent, etc., a liquid impermeable sheet 11 disposed on one side of the liquid retentive sheet 12, and a liquid gradual-releasing sheet made of a fibrous material and less air permeable than the liquid retentive sheet 12 disposed on the other side of the liquid retentive sheet 12. The liquid impermeable sheet 11 has a bag shape with openings 13 on one side thereof. The liquid retentive sheet is held in the bag and releases the detergent, etc. through the openings 13. The liquid gradual-releasing sheet has an air permeability of 0.05 to 6 m/kPa·s thereby to control the gradual release of the detergent, etc.

9 Claims, 8 Drawing Sheets

WET SHEET FOR CLEANING

TECHNICAL FIELD

The present invention relates to a wet cleaning sheet suitable for use in cleaning, polishing or protecting a hard surface. More particularly, it relates to a wet cleaning sheet which releases a large amount of a detergent or a polish to a wide range of surfaces to be cleaned exemplified by floors uniformly from the beginning to the end of cleaning.

BACKGROUND ART

The present applicant previously proposed a floor cleaning sheet characterized by being impregnated with 100 to 1000% by weight, based on the sheet weight, of an aqueous detergent having a viscosity of 20 to 30000 mPa·s at 25° C. (see JP-A-2001-198065). The floor cleaning sheet is typically attached to a mop-like cleaning tool on use. With this floor cleaning sheet, the aqueous detergent is slowly released in a stable manner, and a wide area can be cleaned with good operationality (ease of use). However, the floor cleaning sheet is mainly contemplated to be used to wipe off light dust and dirt, such as hairs, soil dust, and dried soy sauce stains, from flooring. Accordingly, the amount of the detergent the sheet is designed to release per tatami ("tatami" is a 90 cm wide and 180 cm long mat and is used to mean an equivalent area) is as small as 1.6 g or less for first tatami and 0.6 g or less for second to nth tatami. In other words, what is aimed at is very slow release of a detergent. Such a small amount of the released detergent may not be seen as enough to remove heavy persistent stains. That amount can be seen as insufficient particularly in applying a polish. At least about 2 g of a polish should be released per tatami stably in order to give a uniform spread of the polish to flooring. Besides, in applying such an agent as a polish, the sheet should have a liquid impermeable layer on its side to be brought into contact with a mop-like cleaning tool, to which it is attached, so that the cleaning tool may not be soiled.

The present applicant also proposed a detergent-impregnated article (sheet) comprising a detergent retentive layer containing a hydrophobic material and a pair of detergent releasing layers that are denser than the detergent retentive layer, the detergent retentive layer being held in between the detergent releasing layers (see JP-A-10-272082). The main subject to which the article is intended to be applied is glass, and the article is designed to be hand held. Furthermore, the article is characterized in that the release of the detergent is regulated by folding the sheet. Accordingly, the article is not optimally designed to be attached to a tool and to slowly release a detergent from only one side thereof, which is not folded back, to a wide area such as flooring.

The present applicant also proposed a cleaning sheet comprising a wiping part and a liquid absorbent member which absorbs the liquid wiped up with the wiping part, the wiping part being a liquid permeable surface sheet having a large number of projections (see JP-A-9-131288). The proposed cleaning sheet itself is not impregnated with a detergent. It is used to carry out cleaning while wiping up a detergent separately supplied to a surface to be cleaned.

Apart from these cleaning sheets, JP-U-4-33971 discloses a disposable applicator comprising a resin film bag with a joint a part of which is adapted to be opened under applied pressure, a liquid to pasty agent sealed into the bag, an agent-impregnated layer disposed on one side of the bag, an agent permeation controlling layer provided on the agent-impregnated layer, an agent-permeable wiping layer provided on the agent permeation controlling layer, and an agent-impermeable layer disposed on the other side of the bag, all these members being joined together. The resin film bag with a joint a part of which is adapted to be opened under pressure may be replaced with a resin film bag with holes which are sealed with an adhesive film. Since the resin film bag of the applicator is adapted to be opened under pressure, there is a fear that the bag is unintentionally opened under some pressure applied during preparation, transportation or storage, resulting in leakage of the agent. The applicator is not designed to be best suited for slow release of a polish, etc. in treating a wide area such as flooring, nor for attachment to a cleaning tool.

An applicator comprising an agent container having an agent sealed therein, a sealing member attached to the agent container and capable of forming holes in the agent container when removed, and a wiping layer provided on the sealing member is also known (see JP-A-10-127549 and JP-A-10-262889). In view of the drawback of the applicator of JP-U-4-33971 supra that the openable film bag containing an agent is likely to be opened unintentionally by pressure application during preparation, transportation or storage to leak the agent, the above-described applicator is characterized by eliminating such a trouble. According to the publication, where the individual holes formed by removing the sealing member have an area of 1 $mm^2$ or less, and the total opening area is 0.002 to 0.02% of one side area of the container, the applicator releases the agent slowly to have an extended service life, supplying the agent uniformly from beginning to end of application. However, where the individual holes are as small as 1 $mm^2$ or less, and the total opening area ratio to the area of one side of the container is 0.002 to 0.02%, the applicator is incapable of uniformly releasing a large amount of an agent over a wide area to be treated.

Accordingly, an object of the present invention is to provide a wet cleaning sheet capable of releasing a large amount of a detergent or a polish uniformly from the beginning to the end of cleaning to a wide area to be cleaned such as a floor.

DISCLOSURE OF THE INVENTION

The above object of the present invention is accomplished by a wet cleaning sheet includes a liquid retentive sheet made of a fibrous material or a foamed material and impregnated with a predetermined amount of a detergent or a polish. The liquid retentive sheet has a liquid impermeable sheet on one side thereof and a liquid gradual-releasing sheet on the other side thereof. The liquid gradual-releasing sheet is made of a fibrous material and exhibits an air permeability lower than that of the liquid retentive sheet. The liquid gradual-releasing sheet has an air permeability of 0.05 to 6 m/kPa·s so as to control the gradual release of the detergent or the polish.

BEST MODE FOR CARRYING OUT THE INVENTION

Figure 1:
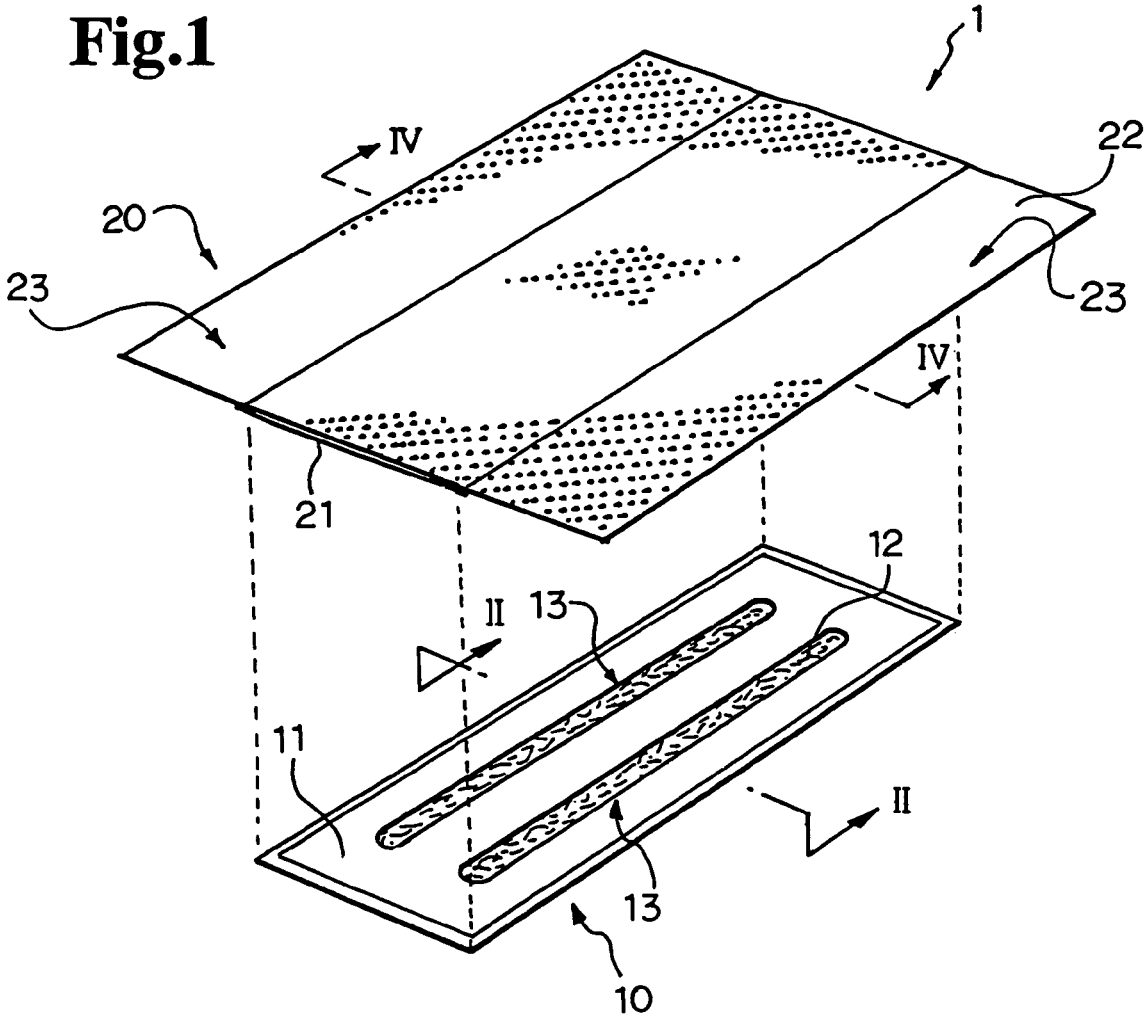
FIG. 1 is a perspective of a wet cleaning sheet according to a first embodiment of the present invention.

The present invention will be described with reference to its preferred embodiments while referring to the accompanying drawings. FIG. 1 shows a perspective of a wet cleaning sheet according to the present invention (hereinafter sometimes referred to simply as "wet sheet"). The wet sheet 1 according to the subject embodiment is suitably used to clean or polish a hard surface, such as flooring. The wet sheet 1 is composed of two members, a first member 10 and a second member 20. Before use the two members 10 and 20 are separate from each other.

Figure 2:
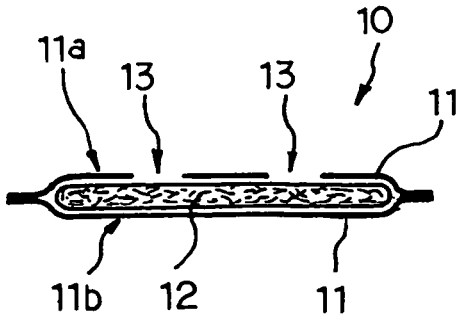
FIG. 2 is a cross-section taken along line II-II in FIG. 1.

As shown in FIG. 2, the first member 10 has a liquid impermeable sheet 11 and a liquid retentive sheet 12. The liquid impermeable sheet 11 is made of a liquid impermeable film. The liquid impermeable sheet 11 has the shape of a flat bag that is rectangular when viewed from above, having a first side 11*a* and a second side 11*b*. The bag is formed by joining two rectangular liquid impermeable sheets 11 at their four edges. The bag-shaped liquid-impermeable sheet 11 has two openings 13 made on a part thereof, specifically on the first side 11*a*. Each opening 13 is an elongated hole extending in the longitudinal direction of the first side 11*a*. Each opening 13 is present over the whole area of the first side 11*a* that faces the liquid retentive sheet 12.

The liquid retentive sheet 12 is made of a fibrous material or a cellular material and enclosedly held in the bag-shaped liquid impermeable sheet 11. The liquid retentive sheet 11 has a rectangular shape slightly smaller than the bag-shaped liquid impermeable sheet 11. The liquid retentive sheet 12 is impregnated with a predetermined amount of a detergent or a polish (hereinafter inclusively referred to as "a detergent" unless otherwise noted). The openings 13 each have such a size and/or an area ratio as to allow an adequate amount of a detergent of the liquid retentive sheet 12 to pass therethrough to the whole of the liquid gradual-releasing sheet described later. Specifically, the area of each opening 13 is preferably 5 to 13,000 $mm^2$, more preferably 5 to 8,700 $mm^2$, so as not to hinder release of a detergent. For the same reason, the ratio of the total area of the openings 13 to the liquid retentive sheet-facing area of the first side 11*a*, namely, the total opening area ratio is preferably 1 to 50%, more preferably 3 to 33%, most preferably 3 to 25%.

Figure 3:
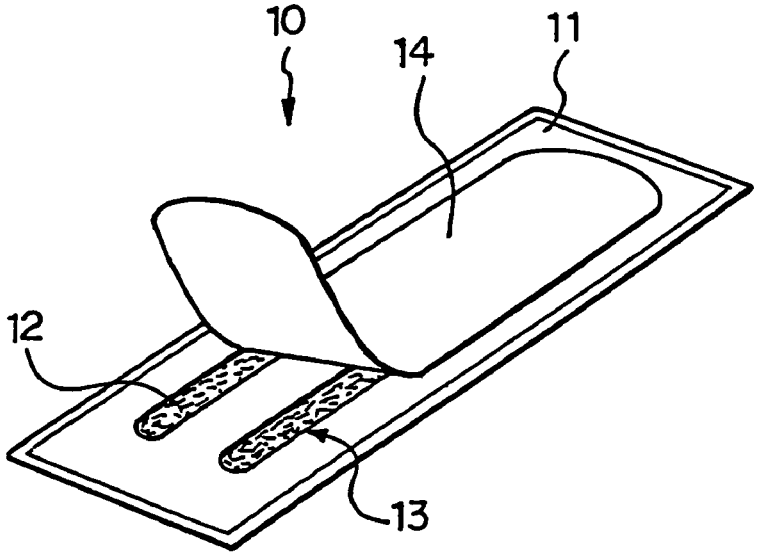
FIG. 3 is a perspective of a first member before use.

As shown in FIG. 3, the first member 10 before use has its openings 13 closed with a seal 14 as means for sealing so that the detergent impregnating the liquid retentive sheet 12 may not leak out from the bag. The seal 14 is stripped off to expose the openings on use.

Figure 4:
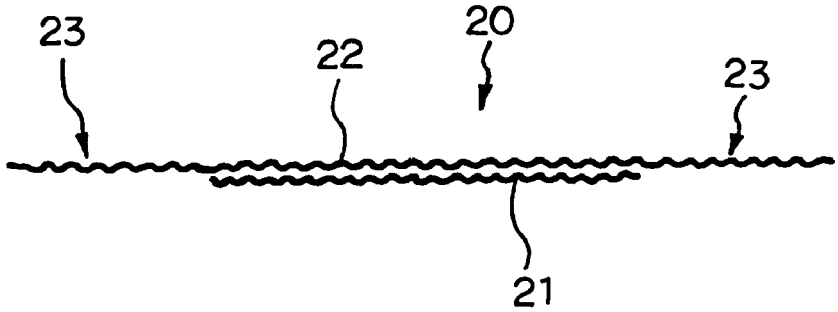
FIG. 4 is a cross-section taken along line IV-IV in FIG. 1.

The second member 20 shown in FIG. 1 is a liquid gradual-releasing sheet composed of an inner sheet 21 and a surface sheet 22. The liquid gradual-releasing sheet may have either a multi-ply structure as in the present embodiment or a single-ply structure. As illustrated in FIG. 4, the two sheets 21 and 22 are superposed on each other and joined together. The inner sheet 21 has a rectangular shape of almost the same size as the bag-shaped liquid impermeable sheet 11. The surface sheet 22 is as long as but wider than the inner sheet 21, laterally extending from both the long sides of the inner sheet 21 to form a pair of flaps 23 and 23 of the second member 20. The usage of the flaps 23 will be described infra. As shown in FIG. 4, the four side edges of the inner sheets 21 are bonded to the surface sheet 22 into a unitary sheet. That is, the liquid gradual-releasing sheet has a two-ply structure.

The liquid gradual-releasing sheet composed of the inner sheet 21 and the surface sheet 22 is made of a fibrous material similarly to the liquid retentive sheet 12. The liquid gradual-releasing sheet is less permeable to air than the liquid retentive sheet 12, however. Air permeability reduces with a decrease in fiber-to-fiber distance. The fiber-to-fiber distance being equal, air permeability reduces with an increase in thickness. The particulars about air permeability will be described later.

The inner sheet 21 has a large number of projections on its surface, whereby to reduce the contact area between the inner sheet 21 and the adjacent upper and lower sheets. As a result, excessive release of a detergent that is liable to occur in the beginning of cleaning is suppressed to improve the gradual releasability. It is desirable that the projections be formed over the entire surface of the sheet. The projections can be formed by, for example, embossing. Matched steel embossing is especially preferred for shape retention in a wet state. The projections include ridges and domes. The inner sheet 21 of the present embodiment have depressions between the projections to have an uneven pattern over the entire area thereof. The depressions and the projections alternate along both the length and the width of the sheet. The shape of the depressions is an inversion of the projections.

In carrying out matched steel embossing to form projections of the inner sheet 21, the emboss pattern is preferably such that the contact area between the inner sheet 21 and the adjacent sheet, whether upper or lower, be 5 to 60% of the entire area of the inner sheet 21. This value will hereinafter be referred to as a contact area ratio. The height of the projections is preferably 0.2 to 10 mm. The cross-sectional shape of the projections is preferably a wave form as illustrated in FIG. 4. The contact area ratio is measured as follows.

1) Spray glue (3M 55, available from Sumitomo 3M Ltd.) is uniformly sprayed to a measuring part of an inner sheet at a rate of about 0.0006 $g/cm^2$.

2) Seven kinds of dust for JIS testing (fine particles of the Kanto loam) are uniformly spread on a flat table.

3) The inner sheet was placed on the table with the glue applied side down, and a flat acrylic resin plate is put thereon. A weight is put on the resin plate to give a total load of 500 g (the weight of the resin plate plus the weight of the weight) to the sheet. The inner sheet after 5 minute application of the load is used as a sample.

4) The surface of the sample is subjected to image analysis. The ratio of the area soiled with the dust to the area having been in contact with the table is calculated to obtain a contact area ratio.

It is desirable for the surface sheet 22 to have a large number of projections similarly to the inner sheet 21 as shown in FIG. 4 for the same reason as for the projections of the inner sheet 21. The projections of the surface sheet 22 can be configured similarly to those of the inner sheet 21 in terms of contact area ratio, shape, and the like.

In using the wet sheet of the present embodiment, the second member 20 is disposed on the first member 10 with the inner sheet 21 of the former facing the first side 11*a* of the latter where openings 13 are made as shown in FIG. 1. The wet sheet 1 in this state is attached to the cleaning tool 30 shown in FIG. 5. The cleaning tool 30 is composed of a flat cleaning part 31, to which the wet sheet 1 is to be attached, and a handle 33 of stick form which is rotatably connected to the cleaning part 31 through a universal joint 32. The cleaning part 31 has a rectangular shape of almost the same size as the first member 10. The wet sheet 1 is attached to the cleaning part 31 with its second side 11*b* (see FIG. 2) in contact with the lower side of the cleaning part 31. The flaps 23 and 23 of the second member 20 are folded back on the upper side of the cleaning part 31. The upper side of the cleaning part 31 is provided with flexible members 34 each having radial slits. The flaps 23 are pressed into the slits and thereby fixed to the cleaning part 31. The wet sheet 1 is thus ready to be used to clean a floor, etc.

Being so configured, the wet sheet 1 according to the above-described embodiment offers the following advantages. Firstly, since the first member 10 and the second member 20 are separate, and the liquid retentive sheet 12 impregnated with a detergent is contained in a bag-shaped liquid impermeable sheet 11 and the sheet 11 is air-tightly sealed, it is possible for the liquid retentive sheet 12 to retain a large quantity of a detergent. Sealed in the liquid impermeable sheet 11, the liquid retentive sheet 12 is prevented from soiling a user's hand when in attaching the wet sheet 1 to the cleaning tool 30. As a matter of course, the cleaning tool 30 is not soiled, either. The detergent is prevented from leaking while stored before use. On use, the seal 14 is stripped off to expose the openings 13, whereby the detergent is released out of the bag, being no more blocked at the openings 13. The detergent released through the openings 13 is once held by the liquid gradual-releasing sheet having low air permeability, i.e., a small fiber-to-fiber distance and high capillarity, and then gradually released therefrom toward the surface to be cleaned. Therefore, the release of the detergent is kept almost constant from the very beginning to the end of a cleaning operation. Since both the inner sheet 21 and the surface sheet 22 constituting the liquid gradual-releasing sheet have projections and depressions, the contact area with the surface to be cleaned is reduced, which also serves for gradual release of the detergent. With the liquid retentive sheet 12 containing a large amount of the detergent, the wet sheet is capable of sufficiently cleaning a wide surface such as a floor. In short, the release of the detergent is controlled not by adjusting the size and/or the open area ratio of the openings 13 but by using a liquid gradual-releasing sheet having a specifically controlled air permeability.

The members making up the wet sheet 1 of the present embodiment will then be described. The liquid impermeable sheet 11 of the first member 10 can be of any material that is soft to some extent and impermeable to liquid. For example, a thermoplastic resin film or a thermoplastic resin film laminated with a vacuum deposited thin film of a metal such as aluminum can be used as the liquid impermeable sheet 11.

The liquid retentive sheet 12 is made of a fiber aggregate or a cellular material as stated. It is desirable that the liquid retentive sheet 12 be capable of holding a large quantity of a detergent and exhibit excellent detergent releasability. Suitable fibrous materials include fiber aggregates, such as bulky paper and nonwoven fabric, particularly air-laid nonwoven fabric and needle-punched nonwoven fabric. The fiber includes natural fibers, chemical fibers, and mixtures thereof. The natural fibers include wood pulp, and the chemical fibers include regenerated fibers, as exemplified by rayon and acetate, and synthetic fibers, such as polyolefin fibers as exemplified by polyethylene and polypropylene, polyester fiber, polyamide fiber as exemplified by nylon, and polyacrylonitrile fiber. Suitable cellular materials include those obtained by foaming or porosification by making use of chemical-reaction-induced gas bubbles or by injecting a low melting solvent, e.g., Freon gas, or air, as exemplified by polyurethane foam and polyolefin foam.

The liquid retentive sheet 12 is more air permeable than the liquid gradual-releasing sheet. Specifically the air permeability of the liquid retentive sheet 12 is preferably 10 to 70 m/kPa·s, more preferably 15 to 40 m/kPa·s. The air permeability was measured on a detergent-free sample with an air permeability tester KES-F8-AP1 supplied by Kato Tech Co., Ltd.

In order for the liquid retentive sheet 12 to have an increased capacity of retaining a detergent and to secure satisfactory release of the detergent while in use, the liquid retentive sheet 12 preferably has a density of 0.02 to 0.2 g/cm$^3$, more preferably 0.03 to 0.15 g/cm$^3$. The basis weight of the liquid retentive sheet 12 is preferably 20 to 400 g/m$^2$, more preferably 60 to 200 g/m$^2$. Within that range of basis weight, the liquid retentive sheet 21 has good fabricability and sufficient liquid retention capacity.

While it is desirable that the liquid retentive sheet 12 be impregnated with as large an amount of a detergent as possible, a usual amount of a detergent to be infiltrated would be about 300 to 3000%, particularly about 500 to 2500%, based on the dry weight of the liquid retentive sheet, assuming that a floor in a common house is cleaned with a single wet sheet 1.

The liquid gradual-releasing sheet of the second member 20 is made of a fibrous material similarly to the above-mentioned liquid retentive sheet 12. The liquid gradual-releasing sheet is a single ply sheet made of a fibrous material or a laminate (multiply) sheet composed of two or more plies made of a fibrous material. The detergent released from the liquid retentive sheet 12 is once diffused throughout the liquid gradual-releasing sheet and then delivered from the liquid gradual-releasing sheet to a wide area to be cleaned at a rate lower than that of the release from the liquid retentive sheet 12. Thus, the liquid gradual-releasing sheet serves to gradually release the detergent in an amount within a prescribed range from the beginning to the end of cleaning. For this purpose, the liquid gradual-releasing sheet is made less air permeable than the liquid retentive sheet 12. In other words, air permeability is a measure of gradual releasability of a detergent in the present invention. It is a fact first found by the present inventors that the air permeability of a sheet is correlative to gradual releasability. In order to control the rate of releasing a detergent within an appropriate range, the air permeability of the liquid gradual-releasing sheet ranges 0.05 to 6 m/kPa·s, preferably 0.1 to 4 m/kPa·s, more preferably 0.1 to 3 m/kPa·s.

The void structure of the liquid gradual-releasing sheet is of importance for air permeability control. For instance, a sheet with voids of smaller size or with a smaller number of voids has lower air permeability to release a lower amount of the detergent. That is, the factors for controlling air permeability include the void structure, the basis weight, the number of plies, etc. of the sheet. Whether the liquid gradual-releasing sheet has a single- or a multi-ply structure, the sheet should be prevented from retaining too much detergent so that it can release a large amount of the detergent gradually and uniformly. From this viewpoint, the basis weight of the liquid gradual-releasing sheet is preferably 20 to 350 g/m$^2$, more preferably 40 to 200 g/m$^2$.

Materials that satisfy the aforethe air permeability include fiber sheets, such as wet process paper, spun laced nonwoven fabric, and melt blown nonwoven fabric. The void structure of wet process paper can be regulated by selecting fiber, adjusting the freeness, wet pressure (pressure applied before drying), and calendering pressure (pressure applied after drying), adding a loading filler, and like means. The fibers of options include soft wood pulp, hard wood pulp, various modified pulps, rayon fiber, and thermoplastic resin fibers. Choosing finer fiber or shorter fiber results in smaller void sizes (diameters) and lower air permeability. Increasing the degree of beating (freeness), the wet pressure or the calendering pressure also results in smaller void sizes and lower air permeability. Increasing the amount of the filler also brings about reduction in size or number of voids, leading to reduction of air permeability. In using spun laced nonwoven fabric, the size of the voids is decreased to reduce air permeability by, for example, using hydrophilic fiber, such as cotton or rayon, using fiber having a small thickness, or increasing the entanglement density. Where the liquid gradual-releasing sheet is to be embossed, it is advisable to use a sheet containing 5 to 95% by weight, particularly 10 to 75% by weight, of thermoplastic fiber, which is easier to heat-emboss to form projections that are retainable even when wet.

Where the liquid gradual-releasing sheet has a laminate structure composed of the inner sheet 21 and the surface sheet 22 as in the present embodiment, there are an advantage that the cleaning operationality is improved further and an advantage that the inner sheet 21 is protected. There is also offered an advantage that the release of the detergent is controlled further. As previously described, the surface sheet 22 has a large number of projections on its cleaning side so as to have improved cleaning operationality. By this surface unevenness, the contact area with a surface to be cleaned reduces to reduce the friction on wiping, which also improves cleaning operationality. The constituent fiber used to make the surface sheet 22 and the shape of the projections of the surface sheet 22 can be the same as those described in JP-A-9-131288.

The inner sheet 21 and the surface sheet 22 may be made of the same or different materials. As long as the basis weight of the liquid gradual-releasing sheet falls within the above-recited range, it is preferred for the surface sheet 22 to have a basis weight ranging 10 to 100 g/m$^2$, particularly 20 to 80 g/m$^2$, in order to secure sufficient sheet strength for cleaning and incur no more cost than necessary.

The detergent and the polish to be infiltrated into the liquid retentive sheet will then be described. The detergent used in the present invention is for dissolving and wiping off dust and dirt that are hard to remove by dry cleaning, such as soil dust, sebum, and grease. The polish is for giving a shine and a protection to flooring. The polish may have a cleaning function as well. For satisfactory spreadability and good finish, the detergent and the polish preferably have a viscosity of 1 to 20 mPa·s, more preferably 2 to 10 mPa·s, at 25° C. The viscosity was measured with a Brookfield viscometer supplied by Tokyo Keiki K.K. (rotor No. 1, 60 rpm). The detergent preferably contains water as a medium, a surface active agent, an alkali agent, and a water-soluble solvent. The polish includes commercially available polishes satisfying the above-recited viscosity condition. The compositions disclosed in JP-A-2001-131495 filed by the present applicant can be mentioned as examples. The detergent or polish is preferably applied to a surface to be treated in an amount of 1.5 to 8 g/tatami, more preferably 2 to 6 g/tatami (tatami≈1.6 m$^2$).

The surface active agent used in the detergent includes anionic, nonionic, cationic, and amphoteric ones. From the standpoint of cleaning ability and finish, suited are nonionic surface active agents, such as polyoxyalkylene (number of moles of alkylene oxide: 1 to 20) C8-C22 alkyl (straight-chain or branched) ethers, C8-C22 alkyl (straight-chain or branched) glycosides (average degree of sugar condensation: 1 to 5), sorbitan C8-C22 fatty acid (straight-chain or branched) esters, and C6-C22 alkyl (straight-chain or branched) glycerol ethers; and amphoteric ones, such as alkylcarboxybetaines, alkylsulfobetaines, alkylhydroxysulfobetaines, alkylamidocarboxybetaines, alkylamidosulfobetaines, and alkylamidohydroxysulfobetaines, each having 8 to 24 carbon atoms in the alkyl moiety thereof. From the viewpoint of cleaning ability and finish, a preferred content of the surface active agent in the detergent is 0.01 to 1.0% by weight, particularly 0.05 to 0.5% by weight.

The alkali agent which can be used in the detergent includes hydroxides, e.g., sodium hydroxide, carbonates, e.g., sodium carbonate, alkaline sulfates, e.g., sodium hydrogensulfate, phosphates, e.g., sodium primary phosphate, organic alkali metal salts, e.g., sodium acetate and sodium succinate, ammonia, alkanolamines, e.g., mono-, di- or triethanolamine, β-aminoalkanols, e.g., 2-amino-2-methyl-1-propanol, and morpholine. Alkanolamines, e.g., mono-, di- or triethanolamine, β-aminoalkanols, e.g., 2-amino-2-methyl-1-propanol, and morpholine are preferred in view of the feel and pH buffering action. A suitable content of the alkali agent in the detergent is 0.01 to 1% by weight, preferably 0.05 to 0.5% by weight, from the standpoint of cleaning ability and feel.

The water-soluble solvent used in the detergent is suitably one or more selected from monohydric alcohols, polyhydric alcohols, and derivatives thereof. Those having a vapor pressure of 267 Pa (2 mmHg) or higher are particularly preferred in view of finish. For example, ethanol, isopropyl alcohol, propanol, ethylene glycol monomethyl ether, propylene glycol monomethyl ether, etc. are preferred. A suitable water-soluble solvent content in the detergent is 1 to 50% by weight, preferably 1 to 20% by weight, from the viewpoint of smell and low skin irritation.

The detergent can contain an antimicrobial agent in addition to the above-described components thereby to endow the detergent with an antimicrobial effect in addition to the cleaning effect. Useful antimicrobial agents include hydrogen peroxide, hypochlorous acid, sodium hypochlorite, quaternary ammonium salts, sodium benzoate, sodium p-hydroxybenzoate, and natural antimicrobials. Quaternary ammonium salts and polylysine (natural antimicrobial agent), etc. are particularly preferred in view of their compounding stability and antimicrobial activity. A suitable content of the antimicrobial agent in the detergent is 0.005 to 2% by weight, particularly 0.01 to 1% by weight, taking into consideration the balance between the antimicrobial effect and low skin irritation.

The detergent, etc. can further contain perfumes, antifungals, colorants (dyes and pigments), chelating agents, waxes, and so forth according to necessity.

The content of water, a medium of the detergent, is preferably 50 to 99.9% by weight, more preferably 80 to 99% by weight, in view of the finish of the cleaned surface.

Second to fourth embodiments of the present invention will be described by way of FIGS. 6 through 8. The second to fourth embodiments will be described only with reference to differences from the first one. The description with respect to the first embodiment appropriately applies to the particulars that are not mentioned here. The members in FIGS. 6 to 8 that are the same as those in FIGS. 1 through 5 are given the same respective reference numbers.

Figure 6:
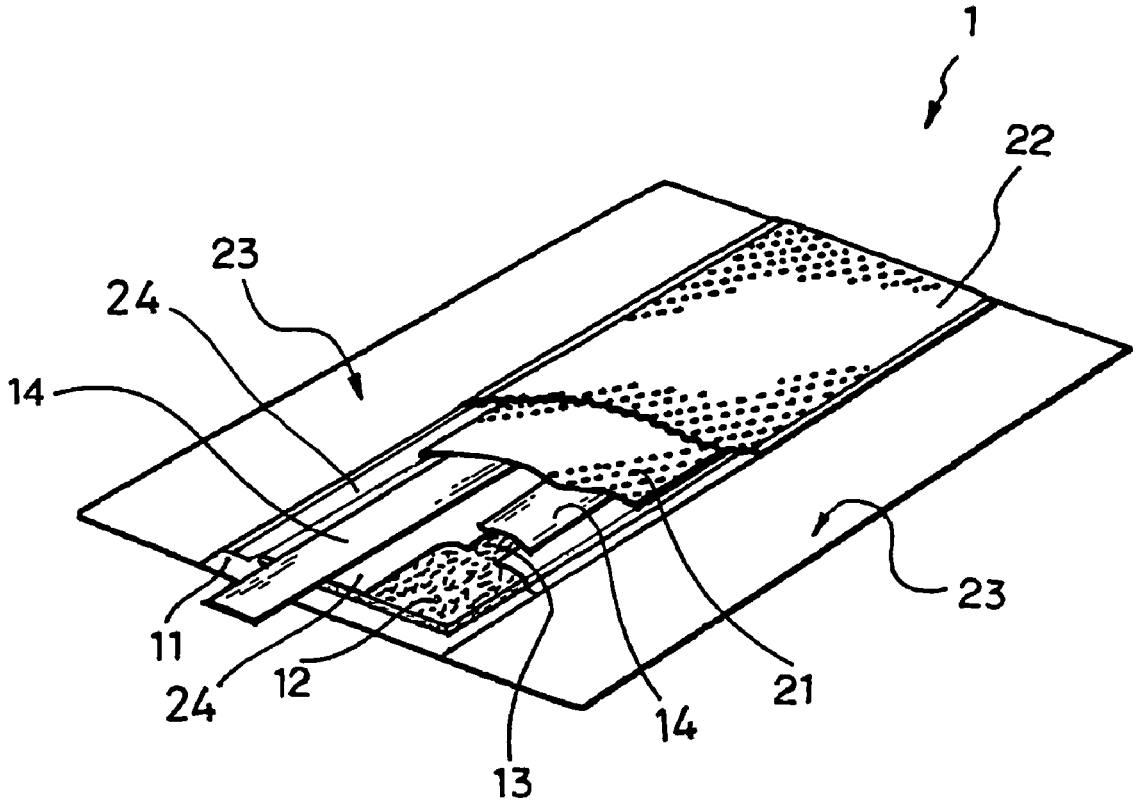
FIG. 6 is a perspective of a wet cleaning sheet according to a second embodiment of the present invention, with a part cut away.

The wet sheet 1 of the second embodiment shown in FIG. 6 is an integral article unlike the wet sheet of the first embodiment. The wet sheet 1 has a liquid retentive sheet 12 made of a fibrous material and impregnated with a detergent. On one side of the liquid retentive sheet 12 is disposed a liquid impermeable sheet 11. On the other side is disposed a liquid gradual-releasing sheet composed of an inner sheet 21 and a surface sheet 22, both of which are made of a fibrous material. The liquid gradual-releasing sheet is less permeable to air than the liquid retentive sheet 12. A liquid impermeable sheet 24 having two openings 13 is provided between the liquid retentive sheet 12 and the liquid gradual-releasing sheet.

The liquid retentive sheet 12 has a rectangular shape and is placed on the liquid impermeable sheet 11. The liquid impermeable sheet 11 extends laterally from both the long sides of the liquid retentive sheet 12 to form a pair of flaps 23 and 23. The inner sheet 21 is a rectangle of the same size as the liquid retentive sheet 12 and is disposed on the liquid retentive sheet 12. The surface sheet 22 is slightly larger than the liquid retentive sheet 12 and the inner sheet 21, extending outward from the four edges of these two lower sheets. The liquid impermeable sheet 24 is of almost the same shape and size as the surface sheet 22. The extensions of the liquid impermeable sheet 24 are bonded to the liquid impermeable sheet 11. The liquid retentive sheet 12 and the inner sheet 21 are thus enclosed in the space formed by the liquid impermeable sheet 11 and the liquid impermeable sheet 24. Both the inner sheet 21 and the surface sheet 22 are provided with projections or depressions.

The openings 13 formed through the liquid impermeable sheet 24 have the same shape as the elongated openings formed through the bag-shaped liquid impermeable sheet 11 of the first embodiment. The openings 13 are closed with respective strip seals 14 so that the detergent impregnating the liquid retentive sheet 12 may not leak. One end of each seal 14 extends outward from an edge of the wet sheet 1. In using the wet sheet 1, the seals 14 are pulled out to expose the openings 13.

Figure 5:
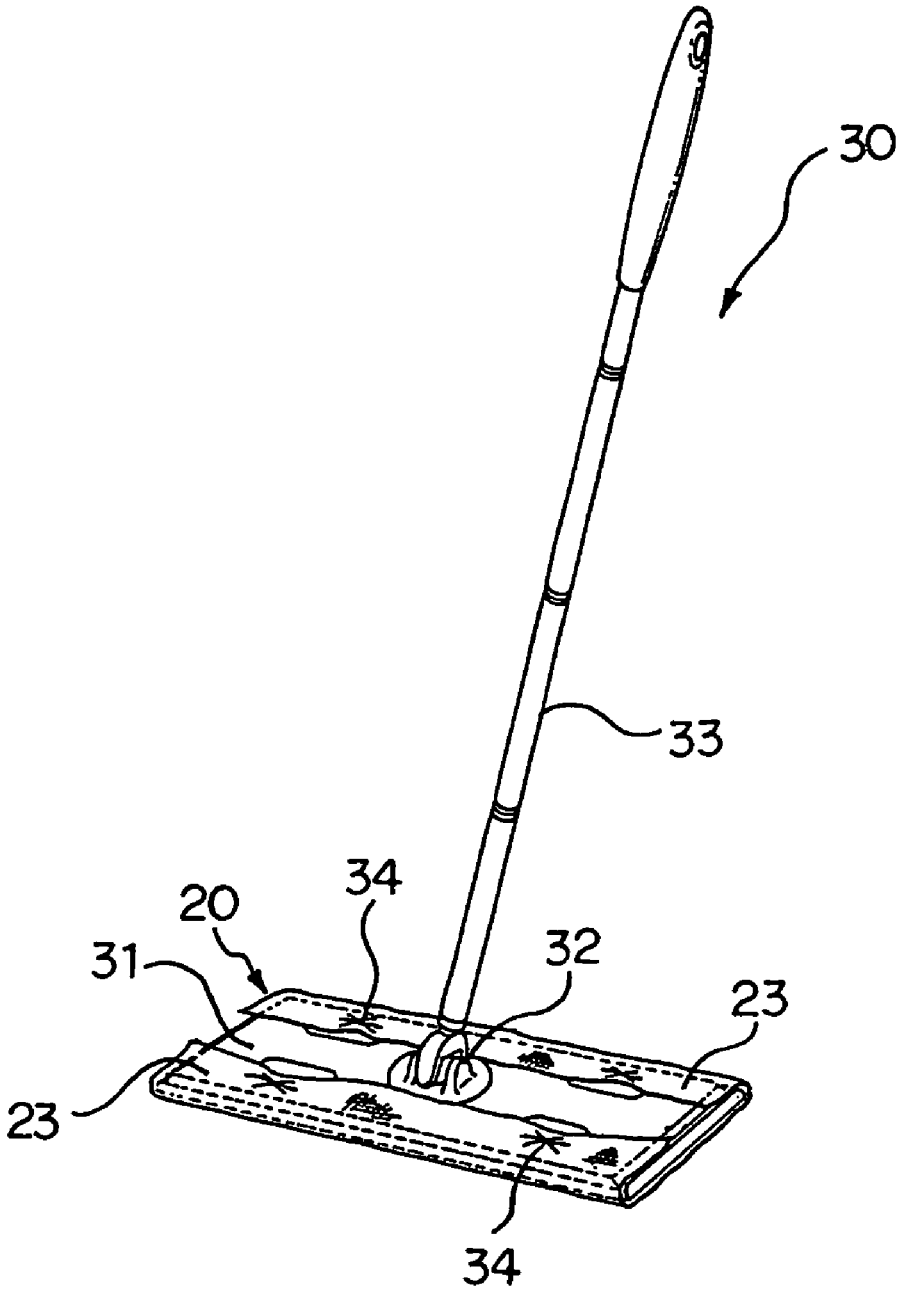
FIG. 5 is a perspective showing the wet cleaning sheet of FIG. 1 in use.

The wet sheet 1 of the second embodiment is used as attached to the cleaning tool 30 shown in FIG. 5 with the outer surface of the liquid impermeable sheet 11 in contact with the lower side of the cleaning part 31 of the cleaning tool 30. According to this embodiment, it is possible to have a large amount of a detergent infiltrated into the liquid retentive sheet 12 because the detergent-impregnated liquid retentive sheet 12 is enclosed in the space formed by the liquid impermeable sheet 11 and the liquid impermeable sheet 24. Similarly to the first embodiment, neither user's hands nor the cooling tool 30 is soiled when the wet sheet 1 is fixed to the cleaning tool 30. The amount of the detergent released is maintained substantially constant from the beginning to the end of cleaning. A large amount of the detergent being retained in the liquid retentive sheet 12, the wet sheet 1 is capable of sufficiently cleaning a wide area such as a floor.

Figure 7:
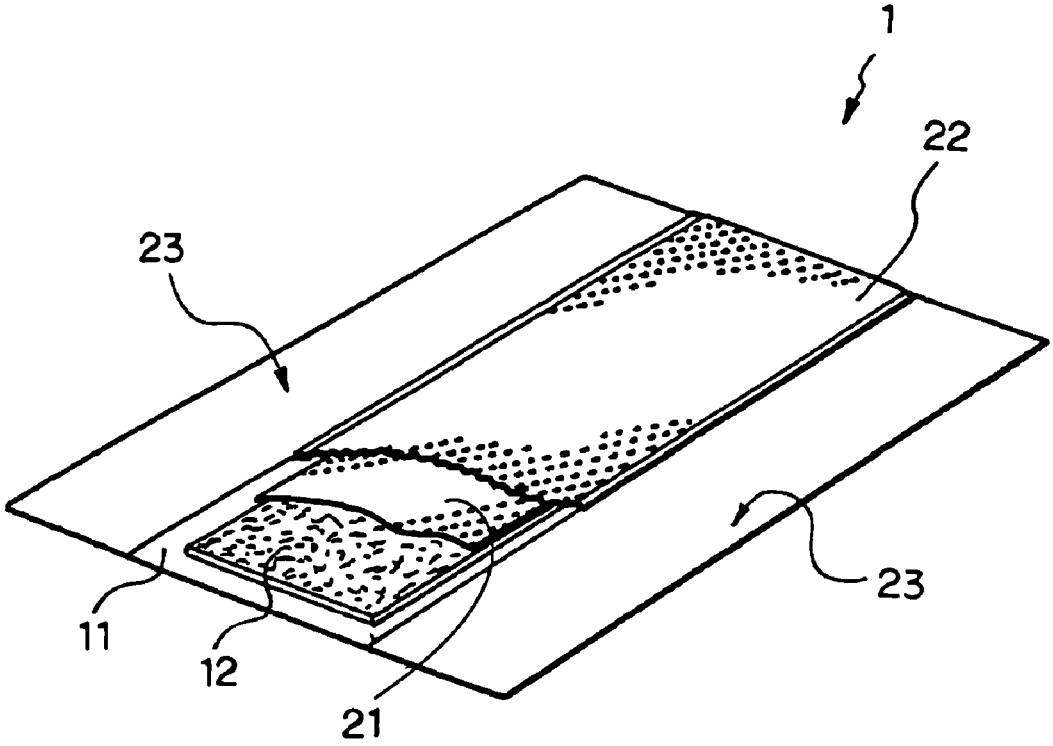
FIG. 7 is a perspective of a wet cleaning sheet according to a third embodiment of the present invention, with a part cut away.
Figure 8:
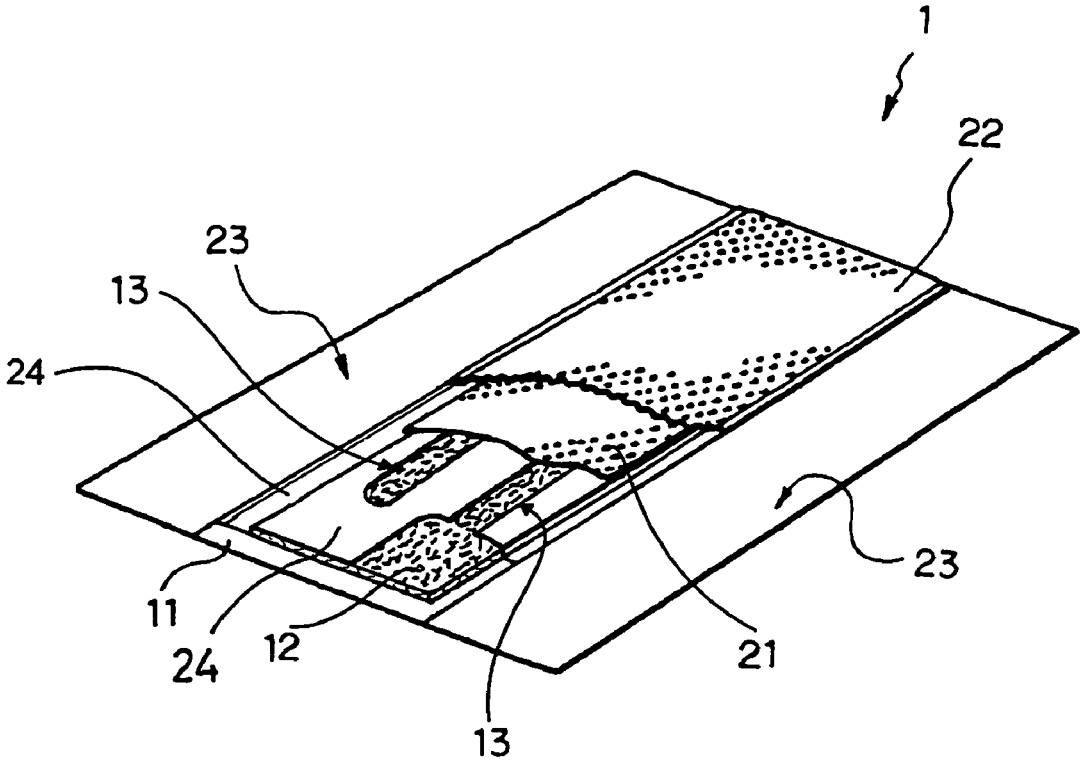
FIG. 8 is a perspective of a wet cleaning sheet according to a fourth embodiment of the present invention, with a part cut away.

The wet sheet 1 according to the third embodiment shown in FIG. 7 corresponds to the wet sheet of the second embodiment shown in FIG. 6 from which the liquid impermeable sheet 24 and the seals 14 closing the openings 13 of the sheet 24 are removed. The wet sheet 1 according to the fourth embodiment shown in FIG. 8 corresponds to the wet sheet of the second embodiment shown in FIG. 6 from which the seals 14 closing the openings 13 of the liquid impermeable sheet 24 are removed. In these wet sheets, the release of the detergent is controlled by adjusting the air permeability of the liquid gradual-releasing sheet as in the first and second embodiments. Unlike the first and second embodiments, however, the wet sheets of the third and fourth embodiments have a possibility that the detergent may ooze out through the inner sheet 21 and the surface sheet 22 under some storage conditions of the wet sheet 1. In such a case, it is desirable that each wet sheet 1 or a few wet sheets 1 be pillow packaged in a liquid impermeable sheet bag for storage.

The fifth embodiment of the present invention will be described by referring to FIGS. 9 through 11. The fifth embodiment will be described only with regard to differences from the first one. The description of the first embodiment applies appropriately to the particulars not mentioned here. The members in FIGS. 9 to 11 that are the same as those in FIGS. 1 through 5 are given the same respective reference numbers.

Figure 9:
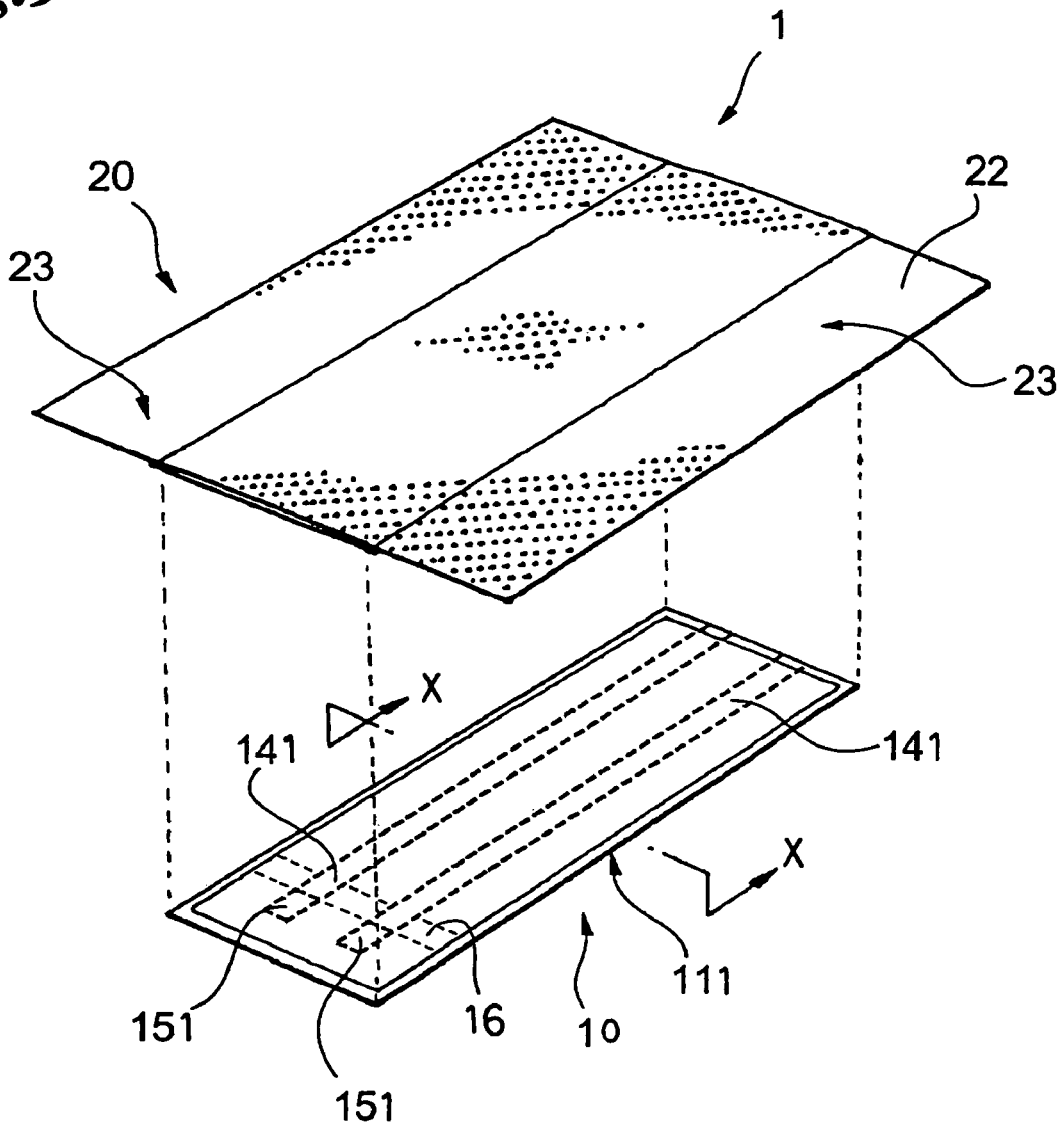
FIG. 9 is a perspective of a wet cleaning sheet according to a fifth embodiment of the present invention.

As shown in FIG. 9, the first member 10 has a container 111 and a liquid retentive sheet 12 held in the container 111. The liquid retentive sheet 12 is contained in the container 111 that is a flat bag and the container 111 is air-tightly sealed. The liquid retentive sheet 12 has a rectangular shape slightly smaller than the container 111.

The container 111 is formed of a first liquid impermeable sheet 11*a* and a second liquid impermeable sheet 11*b*, both of which are laminate sheets composed of a uniaxially stretched film and a metal foil. The two liquid impermeable sheets 11*a* and 11*b* are of the same kind and of the same size, both having an elongated rectangular shape when seen from the above. The container 111 is formed by bonding the four edges of two superposed liquid impermeable sheets 11*a* and 11*b* into a bag shape. The stretching direction of the uniaxially stretched film agrees with the longitudinal direction of the liquid impermeable sheets 11*a* and 11*b*.

The materials of the liquid impermeable sheets 11*a* and 11*b*, which form the container 111, are not particularly limited as long as the sheets are flexible to some extent and impermeable to liquid. For example, a thermoplastic resin film or a thermoplastic resin film laminated with a thin metal (e.g., aluminum) film by vacuum evaporation can be used as the liquid impermeable sheets 11*a* and 11*b* as mentioned above. The two liquid impermeable sheets 11*a* and 11*b* may be either of the same or different kinds. Note that, however, at least the first liquid impermeable sheet 11*a*, which faces the liquid gradual-releasing sheet 21, should have a layer of a uniaxially stretched film.

Figure 10:
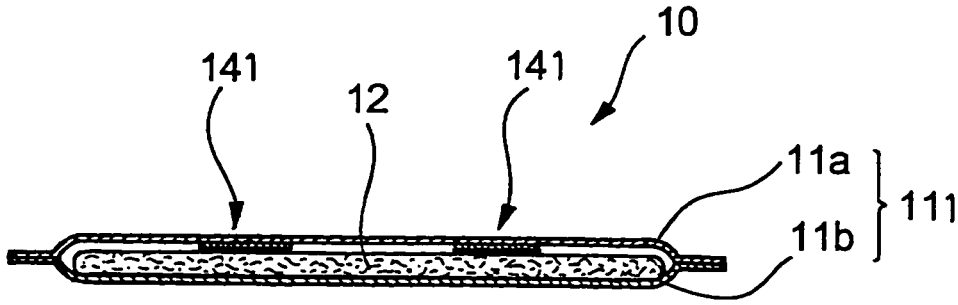
FIG. 10 is a cross-section taken along line X-X in FIG. 9.
Figure 11:
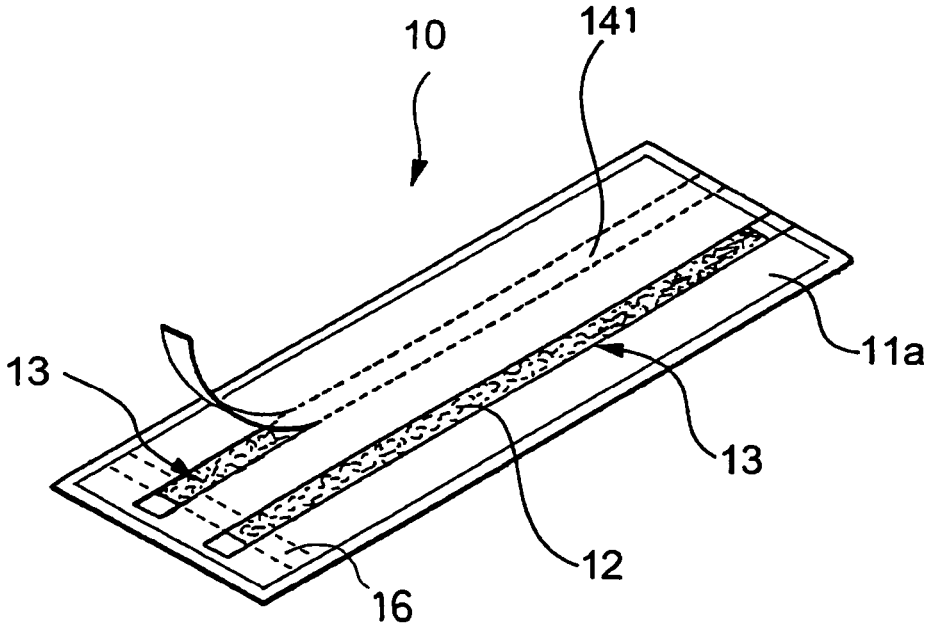
FIG. 11 is a perspective of a first member before use.

As illustrated in FIG. 10, the first liquid impermeable sheet 11*a*, which is to face the second member 20, has two guiding portions for easy-open or easy-to-open portions 141 having a prescribed width and extending in the stretching direction of the uniaxially stretched film. Each of the easy-to-open portions 141 is formed by superposing a strip of a sheet material on the first liquid impermeable sheet 11*a*. Accordingly the easy-to-open portions 141 have a higher basis weight and higher strength than the other part of the first liquid impermeable sheet 11*a*. A uniaxially stretched film is known mechanically strong in the stretching direction but less strong in the direction perpendicular to the stretching direction. Seeing that the stretching direction of the uniaxially stretched film in the present embodiment is the same as the longitudinal direction of the first liquid impermeable sheet 11*a* as noted above, the first liquid impermeable sheet 11*a* is mechanically stronger in the length than in the width and therefore easy to tear along the borders of the easy-to-open portions 141.

The easy-to-open portions 141 are provided over substantially the whole length of the container 111. The easy-to-open portions 141 each have a tab 151 at one end thereof. A part of the first liquid impermeable sheet 11*a* serves as the tab 151. The tab 151 is formed by making that part in a state non-bonded to the first liquid impermeable sheet 11*a*. The tab 151 is a portion providing a starting point for tearing off the easy-to-open portion 141 from the other part of first impermeable sheet 11*a*. The tab 151 is pinched with the fingertips and pulled toward the other end of the easy-to-open portion 141 thereby to tear apart that portion of the first liquid impermeable sheet 11*a* and to make an opening 13. At the root of the tab 151 the first and second liquid impermeable sheets 11*a* and 11*b* are bonded together over the width of the container 111 to form a joint 16. The joint 16 is provided in order that the detergent impregnating the liquid retentive sheet 12 may not ooze outside from the root of the tabs 151 during storage of the container 111.

Before use of the wet sheet 1, the first liquid impermeable sheet inclusive of the easy-to-open portions 141 is in an untorn state, and the liquid retentive sheet 12 held in the container 111 is thus kept in a sealed state. On use, each of the tabs 151 is pinched with the fingertips, pulled up to separate the bonded first and second liquid impermeable sheets 11*a* and 11*b* apart, and pulled further to tear off the easy-to-open portion 141 of the first liquid impermeable sheet in the stretching direction of the sheet as depicted in FIG. 11. By so doing, openings 13 having substantially the same shape of the easy-to-open portions 141 are made in the first liquid impermeable sheet 11*a*, thereby allowing the detergent infiltrated into the liquid retentive sheet 12 to be released from the openings 13.

According to the fifth embodiment, the liquid retentive sheet 12 is kept sealed until immediately before use of the wet sheet 1. The liquid retentive sheet 12 is released from the sealed state for the first time when the easy-to-open portions 141 are torn off in the stretching direction on use. Therefore, a large quantity of a detergent, etc. can be held infiltrated into the liquid retentive sheet 12 without being leaked or evaporated. Unlike the applicator disclosed in JP-A-10-127549 supra, since the wet sheet 1 of the present embodiment needs no sealing member for blocking the openings of a container having an agent sealed therein, it enjoys good productivity and realizes reduction in production cost.

According to the fifth embodiment, although the wet cleaning sheet has a container having sealed therein a large amount of an agent such as a detergent and a polish, it is free from the leakage problem that may occur during the preparation, transportation or storage. On use, a prescribed opening can easily be made in the container to supply a large quantity of a polish, etc. to a wide area such as a floor uniformly from the beginning to the end of cleaning. In addition, the wet cleaning sheet of the embodiment is produced with good productivity, leading to a reduction of the production cost.

While the present invention has been described with respect to the preferred embodiments thereof, it should be understood that the invention is not deemed limited thereto. For example, another sheet or sheets may be superposed on the outer side of the liquid gradual-releasing sheet for the purpose of protecting the liquid gradual-releasing sheet or improving the operationality of the wet sheet.

The inner sheet 21 and/or the surface sheet 22 used in the above-described embodiments do not always need to have projections.

While in the fifth embodiment part of the first liquid impermeable sheet 11*a* is made into easy-to-open portions by superposing strips of a sheet material, some kinds of a uniaxially stretched film need no such easy-to-open portions except pull tabs of prescribed width. In this case, an opening can be made in the first liquid impermeable sheet 11*a* simply by pulling the pull tab in the stretching direction of the film.

While in the fifth embodiment the easy-to-open portions 141 are formed by superposing strips, they can be formed by mechanically drawing lines by laser processing or with a tool, along which the sheet is tearable. By this method even a liquid impermeable sheet containing a less tearable uniaxially stretched film can be made easily tearable.

While in the fifth embodiment the tab 151 at one end of the easy-to-open portion 141 is in a non-bonded state to the second liquid impermeable sheet 11*b*, the tab 151 may be bonded lightly such that it can be peeled with a fingertip.

The wet sheet 1 of the present invention is fit especially for cleaning flooring. It is also suitable for cleaning or polishing other hard surfaces, such as car bodies and leather shoes.

In Examples hereinafter given all the percents are by weight unless otherwise noted.

EXAMPLE 1

A 80 mm wide and 250 mm long sheet of air laid nonwoven fabric (material: soft wood kraft pulp/thermoplastic fiber (heat fusible polyester fiber)/latex binder=52/34/14 by weight; basis weight: 140 g/m$^2$; density: 0.05 g/cm$^3$; air permeability: 10.3 m/kPa·s) was used as a liquid retentive sheet. The liquid retentive sheet was impregnated with 1430% of a cleaning polish (Tsuyadashi Mypet (trade name) available from Kao Corp.; viscosity (25° C.): 4 mPa·s).

Two aluminum deposited sheets having a thickness of 49 μm were used as liquid impermeable sheets. Two elongated holes each of 7.5 mm in width and 210 mm in length were punched out of one of the sheets, and the openings were covered with an adhesive aluminum deposited sheet. The cleaning polish-impregnated liquid retentive sheet was sandwiched in between the two sheets, and the four edges of the two sheets were heat sealed to prepare a 95 mm wide and 270 mm long package with openings (open area ratio of the elongated holes: 12.3%).

Two sheets of paper with a basis weight of 30 g/m$^2$ fabricated by usual wet papermaking from a mixed fiber material (soft wood kraft pulp/thermoplastic fiber (heat fusible polyester fiber)=90/10 by weight) were superposed on each other and joined together by embossing through matched steel rollers to prepare an inner sheet having projections. The resulting inner sheet had an air permeability of 0.3 m/kPa·s. A sheet of paper having a basis weight of 12 g/m$^2$ was prepared by wet papermaking from a mixed fiber material (soft wood kraft pulp/heat shrinkable fiber (polypropylene (core)/polyethylene (sheath) conjugate fiber)/thermoplastic fiber (heat fusible polyester fiber)=30/60/10 by weight) and applying a hydrophilizing agent to the fiber layer during the step of drying. The paper was superposed on spun bonded nonwoven fabric fabricated of polyester (core)/polyethylene (sheath) conjugate fiber to obtain a composite sheet having a basis weight of 40 g/m$^2$, which was embossed through matched steel rollers to prepare a surface sheet. The resulting surface sheet had an air permeability of 6.8 m/kPa·s. The surface sheet and the inner sheet were combined as shown in FIG. 4 to form a liquid gradual-releasing sheet.

The package having openings was put on the liquid gradual-releasing sheet with the side having the openings facing the inner sheet of the liquid gradual-releasing sheet to make a wet sheet having the structure shown in FIG. 1. The wet sheet was attached to a cleaning tool shown in FIG. 5 and used for cleaning.

EXAMPLE 2

A wet sheet was prepared in the same manner as in Example 1, except for the following. The inner sheet used in Example 1 was replaced with two thicknesses of paper which had a basis weight of 30 g/m$^2$ and was prepared by usual wet papermaking from a mixed fiber material of soft wood kraft pulp/thermoplastic fiber (heat fusible polyester fiber)=90/10 by weight. The resulting two-ply inner sheet was used as such without embossing. The inner sheet had an air permeability of 0.3 m/kPa·s.

EXAMPLE 3

A wet sheet was prepared in the same manner as in Example 1, except for the following. The inner sheet used in Example 1 was replaced with two thicknesses of paper which had a basis weight of 30 g/m$^2$ and was prepared from a mixed fiber material of soft wood kraft pulp/thermoplastic fiber (heat fusible polyester fiber)=90/10 by weight under papermaking conditions different in degree of beating, wet pressure, etc. from those adopted in Example 1 so that the resulting inner sheet might have an air permeability of 0.7 m/kPa·s. The resulting inner sheet was used as such without embossing.

EXAMPLE 4

A wet sheet was prepared in the same manner as in Example 1, except for the following. The inner sheet used in Example 1 was replaced with two thicknesses of paper which had a basis weight of 40 g/m$^2$ and was prepared from 100% soft wood kraft pulp under papermaking conditions different in degree of beating, wet pressure, etc. from those adopted in Example 1 so that the resulting inner sheet might have an air permeability of 5.3 m/kPa·s.

COMPARATIVE EXAMPLE 1

A wet sheet was prepared in the same manner as in Example 1, except that the inner sheet was not used. The liquid gradual-releasing sheet of Comparative Example 1 was a single ply sheet.

COMPARATIVE EXAMPLE 2

A wet sheet was prepared in the same manner as in Example 1, except for replacing the inner sheet used in Example 1 with a single sheet of paper having a basis weight of 30 g/m$^2$ that was prepared from a mixed fiber material of soft wood kraft pulp/thermoplastic fiber (heat fusible polyester fiber)/microfibrillated cellulose (Celish KY-100SJ, a trade name, available from Daicel Chemical Industries, Ltd.)=50/10/40 (effective content ratio by weight) by a manual wet papermaking technique. The resulting inner sheet was used as such without embossing. The inner sheet had an air permeability of 0.04 m/kPa·s.

COMPARATIVE EXAMPLE 3

A wet sheet was prepared in the same manner as in Example 1, except for using no inner sheet and replacing the elongated holes of the aluminum deposited sheet with a number of regularly arranged circular holes of 1 mm in diameter to provide a total open area ratio of 0.018%.

Evaluation of Performance:

The wet sheets prepared in Examples and Comparative Examples were evaluated for gradual liquid releasability, capacity of cleaning, and cleaning finish in accordance with the following methods. The results obtained are shown in Table 1 below.

1) Amount of Release

A floor of Woody Tile F type KER525F (from Matsushita Electric Works, Ltd.) was continuously wiped with the wet sheet attached to a cleaning tool Quickle Wiper produced by Kao Corp. The amount of liquid released per tatami was calculated by weighing the wet sheet detached from the cleaning part of the cleaning tool every time it was used to wipe one-tatami area (90 cm×180 cm). Cleaning per tatami was completed by giving a 90 cm double stroke (forward and backward) of the cleaning tool to each of eight divided sections (i.e., 2 sections in the length direction by 4 sections in the width direction).

2) Finish

The same wiping operation as in (1) above was conducted, and the finish of the floor after drying was evaluated with the naked eye.

If an agent, particularly a polish, is released too much, the surface treated in the initial stage of wiping becomes too sheeny compared with the finish in the final stage, resulting in noticeable variation of gloss from place to place. Besides, a polish released too much takes time to dry. On the other hand, if the release of an agent, particularly a polish is too slow, the wet sheet fails to uniformly wet the surface to be treated, resulting in gloss unevenness. Therefore, the finish was evaluated according to the following standard taking the difference depending on the released amount into consideration.

A: Given a uniform coating, the floor has uniform gloss.

B: Given a non-uniform coating, the floor has uneven gloss with high gloss and low gloss parts.

C: Intermediate between A and B.

TABLE 1

| | | Example | | | | Comparative Example | | |
|---|---|---|---|---|---|---|---|---|
| | | 1 | 2 | 3 | 4 | 1 | 2 | 3 |
| Liquid Retentive Sheet | Air Permeability (m/kPa · s) | 10.3 | | | | | | |
| | Density (g/cm$^3$) | 0.05 | | | | | | |
| | Material | air laid nonwoven fabric | | | | | | |
| | Impregnation (%) with Agent | 1430 | | | | | | |
| Liquid Impermeable Sheet | Opening Area | 7.5 mm × 210 mm × 2 holes | | | | | | 0.79 mm$^2$ |
| | Open Area Ratio (%) | 12.3 | | | | | | 0.018 |
| Surface Sheet | Contact Area (%) | 17 | | | | | | |
| | Composition (weight ratio) | pulp/synthetic fiber = 30/70 (embossed) | | | | | | |

TABLE 1-continued

| | | Example | | | | Comparative Example | | |
|---|---|---|---|---|---|---|---|---|
| | | 1 | 2 | 3 | 4 | 1 | 2 | 3 |
| Inner Sheet | Material | embossed | wet process paper non-embossed | non-embossed | non-embossed | none | wet process paper (non-embossed) | None |
| Liquid gradual-Releasing Sheet | Air Permeability (m/kPa · s) | 0.3 | 0.3 | 0.7 | 3.3 | 6.8 | 0.04 | 6.8 |
| Amount of Release (g/tatami)/Finish | 1st tatami | 4.8/a | 6.1/b | 7.1/b | 7.7/b | 9.2/c | 3.0/a | 3.0/c |
| | 2nd tatami | 3.5/a | 3.1/a | 3.5/a | 6.3/b | 5.2/a | 1.9/b | 1.5/c |
| | 3rd tatami | 3.3/a | 2.6/a | 3.9/a | 5.0/a | 4.1/a | 1.5/b | 1.0/c |
| | 4th tatami | 3.0/a | 2.5/a | 2.9/a | 3.7/a | 3.0/a | 1.7/b | 0.7/c |
| | 5th tatami | 2.8/a | 2.6/a | 2.6/a | 2.6/a | 2.2/a | 1.6/b | 0.6/c |
| | 6th tatami | 2.5/a | 2.3/a | 2.3/a | 2.0/a | 1.6/b | 1.4/c | 0.5/c |
| | 7th tatami | 2.3/a | 1.8/b | 1.8/b | 1.6/b | 1.2/c | 1.0/c | 0.5/c |
| Remark | | | | | | noticeable difference in gloss between 1st tatami and the rest of the floor | | streaky unevenness in 1st tatami |

As is apparent from the results in Table 1, it is seen that the wet sheets of Examples according to the present invention release a sufficient amount of the liquid even in the stage of cleaning the seventh tatami with a small reduction in amount of release with wiping area and give a satisfactory finish to the floor. In contrast, because the wet sheet of Comparative Example 1 releases too much while wiping the first tatami, it provides a higher gloss to the first tatami than the second and following tatami areas, resulting in unevenness of gloss. It is also seen that the wet sheet of Comparative Example 1 shows a great reduction in amount of release, failing to achieve cleaning of the seventh tatami area. Although the wet sheet of Comparative Example 2 shows a small reduction in amount of release, it is incapable of cleaning a wide area and provides a poor finish. The wet sheet of Comparative Example 3 releases only a small amount of the liquid from the beginning of wiping because the release from the liquid retentive sheet is hindered by the holes. The insufficient release also results in uneven and streaky application of the liquid.

INDUSTRIAL APPLICABILITY

The wet cleaning sheet of the present invention releases a large amount of a detergent or a polish to a wide area such as a floor stably and uniformly from the beginning to the end of cleaning. In applying a polish, in particular, the wet cleaning sheet provides the whole wiped area with a uniform gloss.

The invention claimed is:

1. A wet cleaning sheet comprising a liquid retentive sheet made of a fibrous material or a foamed material and impregnated with a predetermined amount of a detergent or a polish, the liquid retentive sheet having a liquid impermeable sheet on one side thereof and a liquid gradual-releasing sheet on the other side thereof, the liquid gradual-releasing sheet being made of a fibrous material and exhibiting an air permeability lower than that of the liquid retentive sheet, wherein the wet cleaning sheet further comprises a sheet with an opening having an area of 5 to 13,000 $mm^2$ interposed between the liquid retentive sheet and the liquid gradual-releasing sheet, the sheet with an opening having an open area ratio of 1 to 50% based on the area facing the liquid retentive sheet, and wherein the liquid gradual-releasing sheet has an air permeability of 0.05 to 6 m/kPa·s so as to control the gradual release of the detergent or the polish.

2. The wet cleaning sheet according to claim 1, wherein the opening is in a closed state with a prescribed sealing means and is adapted to be released from the closed state on use of the wet cleaning sheet.

3. The wet cleaning sheet according to claim 2, wherein the liquid impermeable sheet has a shape of bag, the bag is provided with the opening at a part thereof, the liquid retentive sheet is held in the bag-shaped liquid impermeable sheet, and the liquid gradual-releasing sheet is arranged so as to face the opening-formed side of the bag-shaped liquid impermeable sheet.

4. The wet cleaning sheet according to claim 3, wherein the liquid gradual-releasing sheet and the bag-shaped liquid impermeable sheet are separate from each other before use.

5. The wet cleaning sheet according to claim 1, wherein the liquid gradual-releasing sheet has projections and depressions.

6. The wet cleaning sheet according to claim 1, wherein the detergent or the polish impregnated in the liquid retentive sheet has a viscosity of 1 to 20 mPa·s at 25° C.

7. A wet cleaning sheet comprising a liquid retentive sheet made of a fibrous material or a foamed material and impregnated with a predetermined amount of a detergent or a polish, the liquid retentive sheet having a liquid impermeable sheet on one side thereof and a liquid gradual-releasing sheet on the other side thereof, the liquid gradual-releasing sheet being made of a fibrous material and exhibiting an air permeability lower than that of the liquid retentive sheet, wherein:

the liquid gradual-releasing sheet has an air permeability of 0.05 to 6 m/kPa·s so as to control the gradual release of the detergent or the polish, the liquid retentive sheet is contained in a bag comprising the liquid impermeable sheet which contains a uniaxially stretched film layer, the bag being air-tightly sealed, the liquid gradual-releasing sheet is arranged on the side of the liquid impermeable sheet which contains the uniaxially stretched film layer, the wet cleaning sheet further comprises an opening, and the liquid impermeable sheet which contains the uniaxially stretched film layer has a tab for starting tearing the uniaxially stretched film layer in the stretching direction to form said opening.

8. The wet cleaning sheet according to claim 7, wherein the tab is formed of part of the uniaxially stretched film.

9. The wet cleaning sheet according to claim 7, wherein the liquid impermeable sheet which contains the uniaxially stretched film layer has a guiding part for easy-open which has a prescribed width and extends in the stretching direction of the uniaxially stretched film layer.

* * * * *

UNITED STATES PATENT AND TRADEMARK OFFICE

CERTIFICATE OF CORRECTION

PATENT NO. : 7,614,110 B2
APPLICATION NO. : 10/521961
DATED : November 10, 2009
INVENTOR(S) : Akai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1078 days.

Signed and Sealed this

Nineteenth Day of October, 2010

David J. Kappos

David J. Kappos
*Director of the United States Patent and Trademark Office*